US012667161B2

(12) United States Patent
Ho

(10) Patent No.: US 12,667,161 B2
(45) Date of Patent: Jun. 30, 2026

(54) SHOE INCLUDING A TREAD PATTERN

(71) Applicant: Vionic Group LLC, San Rafael, CA (US)

(72) Inventor: David Ho, San Francisco, CA (US)

(73) Assignee: Vionic Group LLC, San Rafael, CA (US)

( * ) Notice: Subject to any disclaimer, the term of this patent is extended or adjusted under 35 U.S.C. 154(b) by 0 days.

(21) Appl. No.: 18/933,118

(22) Filed: Oct. 31, 2024

(65) Prior Publication Data

US 2025/0134206 A1 May 1, 2025

Related U.S. Application Data

(60) Provisional application No. 63/594,625, filed on Oct. 31, 2023.

(51) Int. Cl.
*A43B 13/14* (2006.01)
*A43B 13/22* (2006.01)

(52) U.S. Cl.
CPC ..... *A43B 13/14* (2013.01); *A43B 13/223* (2013.01)

(58) Field of Classification Search
CPC ..... A43B 13/14; A43B 13/223; A43B 3/0068; A43B 13/26
USPC ..... 36/59 C, 59 R; D2/959, 960
See application file for complete search history.

(56) References Cited

U.S. PATENT DOCUMENTS

| | | | | |
|---|---|---|---|---|
| 8,322,050 | B2 * | 12/2012 | Lubart | A43B 13/223 D2/960 |
| 9,173,450 | B2 * | 11/2015 | Minami | A43C 15/167 |
| 2006/0059716 | A1 * | 3/2006 | Yamashita | A43B 13/223 36/59 R |
| 2009/0188132 | A1 * | 7/2009 | Fujikawa | A43B 13/223 36/103 |
| 2013/0067778 | A1 * | 3/2013 | Minami | A43C 15/16 36/59 R |
| 2019/0104806 | A1 * | 4/2019 | Cass | B32B 27/12 |

* cited by examiner

*Primary Examiner* — Haley A Smith
(74) *Attorney, Agent, or Firm* — Husch Blackwell LLP

(57) ABSTRACT

A tread pattern for a shoe is provided that improves the comfort, grip, and/or other aspects of the shoe as perceived by a consumer when the shoe is worn. The tread pattern comprises a plurality of tread members positioned on at least a portion of the bottom surface of the outsole of the shoe. In some instances, the plurality of tread members may be arranged in nested rows to form the tread pattern. In other instances, the plurality of tread members may be arranged in other configurations to form different tread patterns. Additionally, the tread members may be substantially V-shaped and include a first arm, a second arm, and a vertex. Each tread members may be contoured such that at least a portion of the tread member protrudes a greater distance from the bottom surface of the outsole of the shoe than at least another portion of the tread member.

18 Claims, 6 Drawing Sheets

SHOE INCLUDING A TREAD PATTERN

CROSS-REFERENCE TO RELATED APPLICATIONS

This application claims priority to U.S. Provisional Patent Application No. 63/594,625, filed Oct. 31, 2023, the disclosure of which is hereby incorporated by reference in its entirety.

FIELD OF INVENTION

The present invention relates generally to a shoe. More specifically, the present invention relates to a shoe having a tread pattern composed of individual tread members designed to improve the comfort, traction, and overall functionality of the shoe.

BACKGROUND OF INVENTION

When deciding whether to purchase a shoe, consumers evaluate many of the shoe's features including the shoe's exterior appearance, the shoe's functionality, and the quality of the shoe's construction. One of the foremost features evaluated by consumers is the comfort provided by the shoe during wear. Various components may impact the amount of comfort the wearer perceives that the shoe provides, such as the arch support provided by the shoe, the cushioning of the sole, and the materials used to construct the shoe. Importantly, the shoe tread, and the patterns disposed thereon, can greatly impact the comfort and performance characteristics of the shoe.

Unfortunately, many shoe treads are designed such that they do not provide the comfort or the functionality desired by consumers. For example, if the tread lacks grooves, patterns, or depth, the shoe may not provide the consumer with adequate surface grip as the consumer walks. This deficiency could increase the risk that the consumer will slip or may cause the consumer to expend additional effort to maintain balance while walking.

Moreover, poorly designed shoe treads may cause discomfort when the shoe is worn in several ways. For example, poorly designed shoe treads may not properly distribute the consumer's weight as the consumer walks. This may result in localized high-pressure points on the consumer's foot, which in turn may cause discomfort, soreness, and even blister formation. As an additional example, poorly designed shoe treads may have limited shock absorption capabilities due to inadequate tread depth or sub-optimal spacing between the tread features. In turn, this can lead to increased stress on the consumer's foot and joints, potentially causing discomfort, fatigue, and other issues.

SUMMARY OF INVENTION

The present invention overcomes many of the shortcomings and limitations of the prior art devices discussed above. The invention described includes several embodiments of a shoe including a tread pattern that provides improved comfort and grip when the shoe is worn. The tread pattern comprises a plurality of tread members positioned and located on a bottom surface of an outsole of the shoe. In some instances, the tread members may be organized in nested rows on at least a portion of the bottom surface of the outsole to form the tread pattern. The tread members may also be alternatively arranged and/or positioned in alternative locations on the outsole to form different tread patterns. In some instances, the tread members may be substantially V-shaped and include a first arm, a second arm, and a vertex. Additionally, the tread members may be contoured such that their thicknesses vary along the first and second arms and at the vertex.

These and other aspects and advantages of the present invention will become apparent to those skilled in the art after considering the following detailed description in connection with the accompanying drawings.

Figure 1:
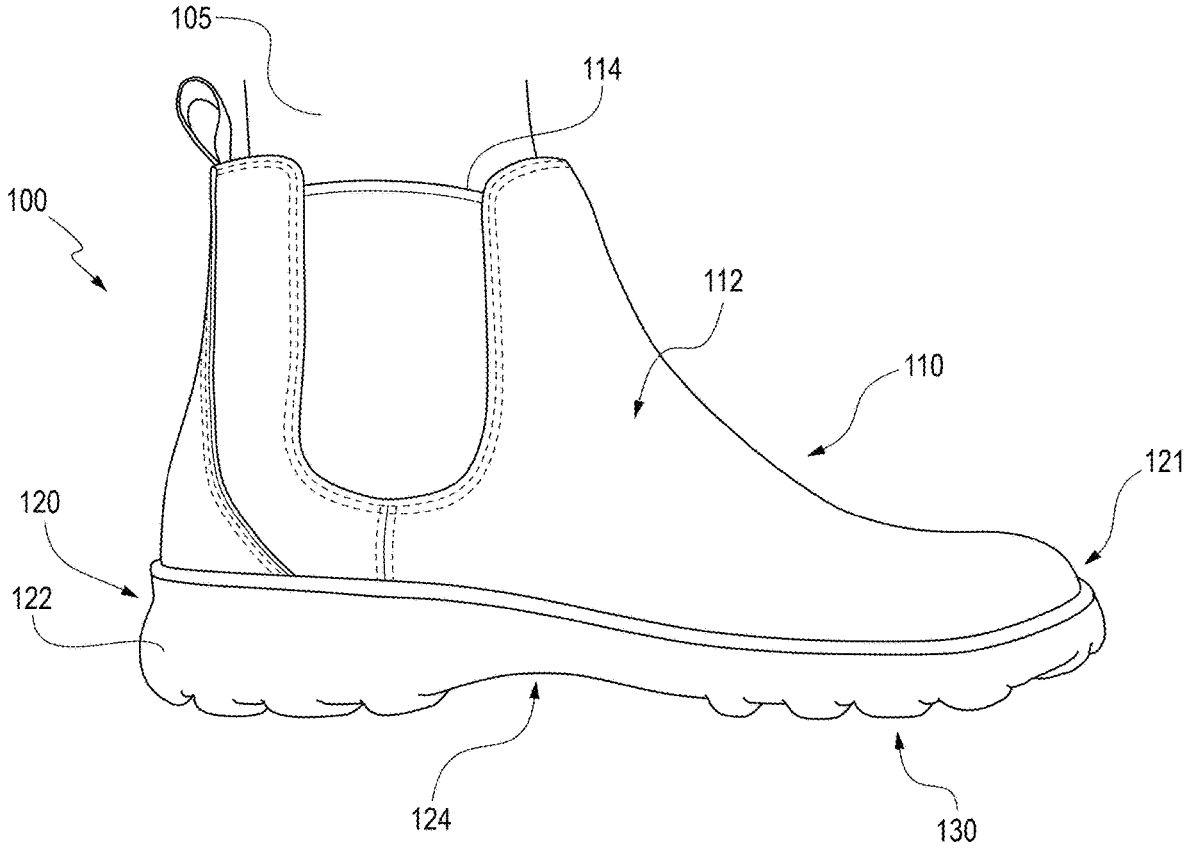
FIG. 1 is a right-side elevation view of a shoe including an example sole constructed according to the teachings herein.

While the disclosure is susceptible to various modifications and alternative forms, a specific embodiment thereof is shown by way of example in the drawings and will herein be described in detail. It should be understood, however, that the drawings and detailed description presented herein are not intended to limit the disclosure to the particular embodiment disclosed, but to the contrary, the intention is to cover all modifications, equivalents, and alternatives falling within the spirit and scope of the present disclosure as defined by the appended claims.

DETAILED DESCRIPTION

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

Turning to FIG. 1, a shoe 100 is shown. The shoe 100 may generally be designed to receive a foot of a wearer 105. The shoe 100 may comprise an upper 110, an outsole 120, and a tread pattern 130. The upper 110 may be provided in the form of a body 112 that includes an opening or mouth 114. The wearer 105 may insert his or her foot into the opening 114 such that the foot can be received into the body 112 of the shoe 100. The outsole 120 may be coupled to a bottom portion 121 of the body 112 and the outsole 120 may include side surfaces 122 and a bottom surface 124. In some instances, the outsole 120, or portions of the outsole 120, may comprise a durable material such as a high traction rubber that provides additional traction and "bounce" as the wearer 105 walks. In other instances, the outsole 120 may comprise other durable materials such as rubber, leather, cork, gel, polyurethane, EVA foam, and/or any other material used in the production of shoes.

When the shoe 100 is worn and the wearer 105 is in a standing position, at least a portion of the bottom surface 124 may generally contact the ground or the surface upon which the wearer 105 walks, providing grip and increasing the comfort of the wearer 105. In FIG. 1, the shoe 100 is provided in the form of a Chelsea boot. However, in other instances, the shoe 100 may be a sandal, sneaker, flip-flop, work boot, knee-high boot, tennis shoe, loafer, flat, moccasin, or any other kind of foot covering designed to be worn and walked in by a wearer.

The bottom surface 124 of the outsole 120 may include the tread pattern 130, which is designed to improve the comfort, grip, and/or other aspects of the shoe 100. The tread pattern 130 may protrude from the bottom surface 124 and extend outwardly therefrom. For example, the tread pattern 130 may extend toward the ground and away from the foot of the wearer 105 when the wearer 105 is in the standing position.

Figure 2:
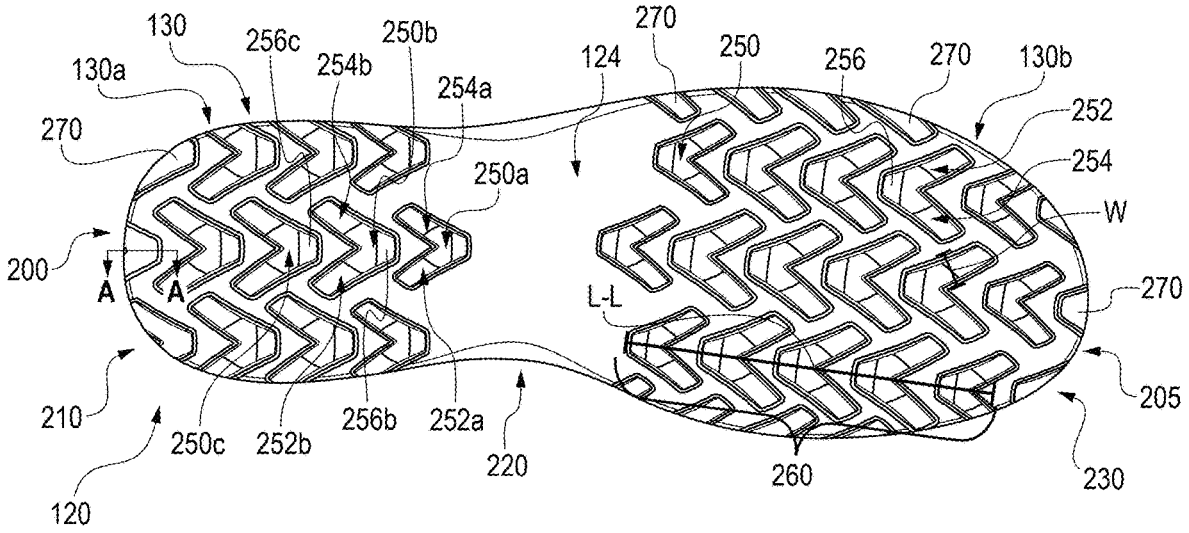
FIG. 2 is a bottom plan view of a shoe illustrating an example sole pattern provided on the sole of the shoe.

FIG. 2 provides a detailed view of the tread pattern 130 positioned and located on the bottom surface 124 of the outsole 120. The tread pattern 130 may comprise a plurality of tread members 250. In the example of FIG. 2, the tread members 250 are substantially V-shaped, each tread member 250 including a first arm 252, a second arm 254, and a vertex 256. Generally, the arms 252, 254 may extend from the vertex 256 and curve outwardly as the arms 252, 254 extend away from the vertex 256. Further, each of the arms 252, 254 have a width W that is substantially constant along a length of the arms 252, 254, although the arms 252, 254 may be provided such that their width W is not substantially constant along their length. In other instances, the tread members 250 may have a different shape than described herein. For example, in some instances, the tread members 250 may have a substantially triangular shape, a substantially semicircular shape, or any other shape known in the art.

The bottom surface 124 of the outsole 120 may comprise a first region 210, a second region 220, and a third region 230. The second region 220 may be positioned and located between the first and third regions 210, 230. The tread pattern 130 may be applied to at least one of the regions 210, 220, 230. For example, as illustrated in FIG. 2, the tread pattern 130 may be applied to the first region 210 and third region 230, while the second region 220 may be maintained as a substantially smooth surface devoid of tread features. However, in other instances, the tread pattern 130 may be applied in different locations on the outsole 120. For example, the tread pattern 130 may be applied to the entirety of the bottom surface 124 of the outsole 120.

To form the tread pattern 130, the plurality of tread members 250 may be arranged in one or more nested rows 260. Each nested row 260 may comprise one or more of the plurality of tread members 250 arranged in a linear configuration. For example, the tread members 250 of a nested row 260 may be arranged such that each tread member 250 is bisected by a line, the line represented in FIG. 2 by the line segment L-L. In some instances, the tread pattern 130 may comprise multiple adjacent nested rows 260. In that case, the lines bisecting each nested row 260, as shown by line segment L-L, may be substantially parallel to one another. Alternatively, the nested rows 260 may be arranged such that only some of the tread members 250 are bisected by a line segment. In yet other alternatives, the nested rows 260 may be arranged such that the line segments bisecting the nested rows 260 are not substantially parallel.

Additionally, the tread members 250 within a nested row 260 may be positioned such that the arms 252, 254 of one tread member 250 are proximate to the vertex 256 of another tread member 250. For example, the arms 252*a*, 254*a* of a first tread member 250*a* may be positioned proximate to a vertex 256*b* of a second tread member 250*b*, the vertex 256*b* being generally positioned between the arms 252*a*, 254*a*. The arms 252*b*, 254*b* of the second tread member 250*b* may in turn be positioned proximate to a vertex 256*c* of a third tread member 250*c*, the vertex 256*c* generally positioned between the arms 252*b*, 254*b*. This general arrangement of the tread members 250 may be repeated for any number of additional tread members 250.

As can be seen in FIG. 2, the tread pattern 130 may comprise a first segment 130*a* and a second segment 130*b*. The first segment 130*a* may be applied to the first region 210 of the bottom surface 124, whereas the second segment 130*b* may be applied to the third region 230 of the bottom surface 124. The first and second segments 130*a*, 130*b* may each comprise one or more of the plurality of tread members 250, which in turn may be organized into one or more nested rows 260.

In some instances, the orientation of the tread members 250 of the first segment 130*a* may differ from the orientation of the tread members 250 of the second segment 130*b*. For example, the tread pattern 130 may be configured such that the arms 252, 254 of each tread member 250 extend away from the second region 220 regardless of whether the particular tread member 250 is positioned in the first segment 130*a* or the second segment 130*b* of the tread pattern 130. As such, the tread members 250 of the first segment 130*a* may be oriented such that the arms 252, 254 extend from the vertex 256 toward a first end 200 of the outsole 120. Likewise, the tread members 250 of the second segment 130*b* may be oriented such that the arms 252, 254 extend from the vertex 256 toward a second end 205 of the outsole 120. Alternatively, the tread members 250 may be arranged in the first and second segments 130*a*, 130*b* such that the arms 252, 254 all extend in the same general direction.

Still referring to FIG. 2, in addition to the one or more tread members 250, the tread pattern 130 may comprise one or more peripheral members 270 positioned on or near the outside edge of the bottom surface 124 of the outsole 120. In some instances, the peripheral members 270 may be formed in the shape of a segment or portion of a tread member 250. In other instances, each peripheral member 270 may have its own unique shape and/or size. Like the tread members 250, the peripheral members 270 may be connected to and extend outwardly from the bottom surface 124 of the outsole 120.

Figure 3:
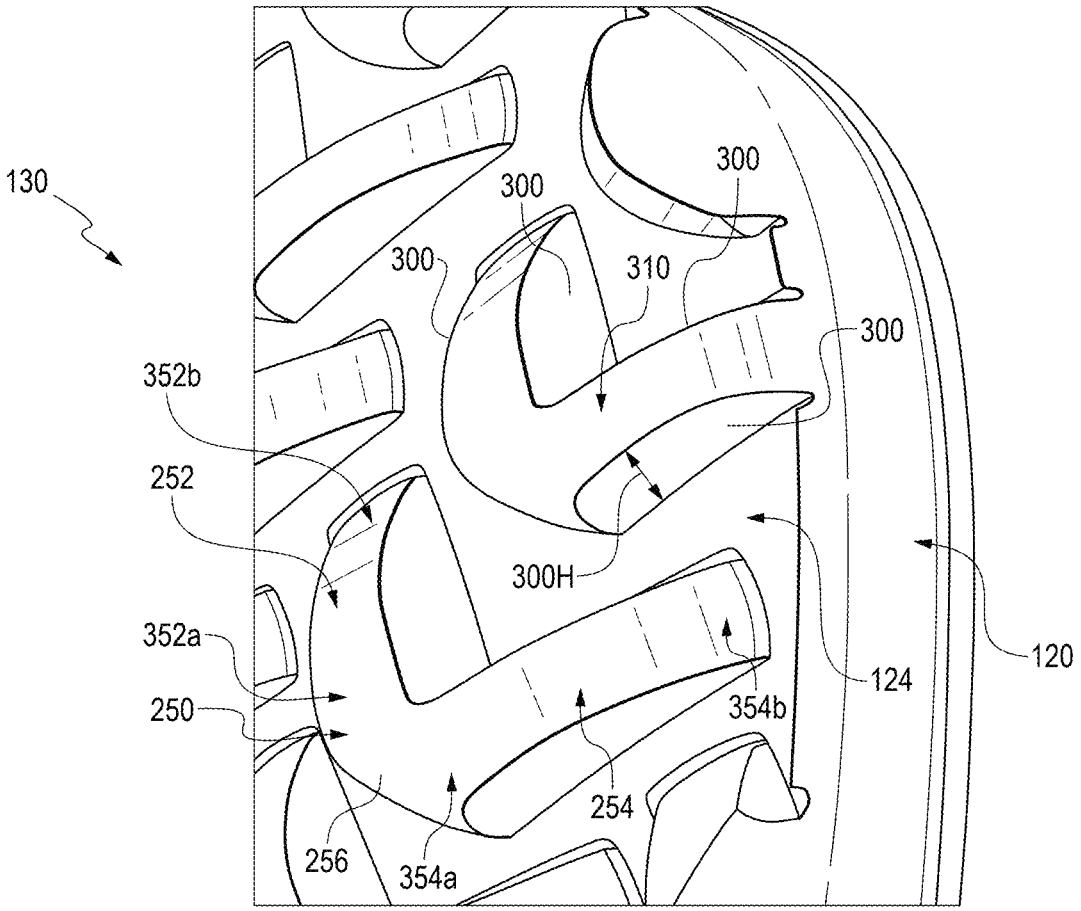
FIG. 3 is a partial bottom perspective view of the shoe of FIG. 2.

Turning to FIG. 3, contouring of the tread members 250 is shown. The plurality of tread members 250 may protrude from the bottom surface 124 of the outsole 120 such that each tread member 250 may comprise one or more sidewalls 300. In the example of FIG. 3, each of the arms 252, 254 of each tread member 250 comprises two sidewalls 300.

Each sidewall 300 may have a height 300H. The tread members 250 may be contoured such that the height 300H is variable at different points along the arms 252, 254. Thus, at any given point along the arms 252, 254, the height 300H of the sidewall 300 represents the distance between the bottom surface 124 of the outsole 120 and an underside 310 of the tread member 250.

As seen in FIG. 3, the first arm 252 of each tread member 250 may have a proximal end 352*a* and a distal end 352*b*. Likewise, the second arm 254 of each tread member 250 may have a proximal end 354*a* and a distal end 354*b*. The proximal end 352*a* of the first arm 252 and the proximal end 354*a* of the second arm 254 may converge at or near the vertex 256. The height 300H of the sidewall 300 at the proximal ends 352*a*, 354*a* may be greater than the height 300H of the sidewall 300 at the distal ends 352*b*, 354*b*.

In some instances, the height 300H of a sidewall 300 at one of the proximal ends 352*a*, 354*a* may be at least about 6 millimeters (mm). For example, the height 300H of the sidewall 300 at one of the proximal ends 352*a*, 354*a* may be at least about 3 mm, or at least about 4 mm, or at least about 5 mm, or at least about 6 mm.

The height 300H of a sidewall 300 at one of the distal ends 352*b*, 354*b* may be about 1 mm. For example, the height 300H of the sidewall 300 at one of the distal ends 352*b*, 354*b* may be no more than about 1 mm, or no more than about 2 mm, or no more than about 3 mm.

Alternatively, the height 300H of a sidewall 300 at one of the distal ends 352*b*, 354*b* may be 1 mm. For example, the height 300H of the sidewall 300 at one of the distal ends 352*b*, 354*b* may be no more than 1 mm, or no more than 2 mm, or no more than 3 mm.

Additionally, the height 300H of each sidewall 300 may taper from the proximal ends 352*a*, 354*a* to the distal ends 352*b*, 354*b*. The rate of tapering may be constant, the rate of tapering may vary, and/or the rate of tapering may be discontinuous. In some instances, the rate of tapering may be defined as a decrease in the height 300H of the sidewall 300 of at least about 1 mm per a defined unit length. The defined unit length may be at least about 5 mm. For example, the defined unit length may be at least about 5 mm, or at least about 6 mm, or at least about 7 mm, or at least about 8 mm.

Alternatively, the rate of tapering may be defined as a decrease in the height 300H of the sidewall 300 of at least 1 millimeter (mm) per a defined unit length. The defined unit length may be at least 5 mm. For example, the defined unit length may be at least 5 mm, or at least 6 mm, or at least 7 mm, or at least 8 mm.

Figure 4:
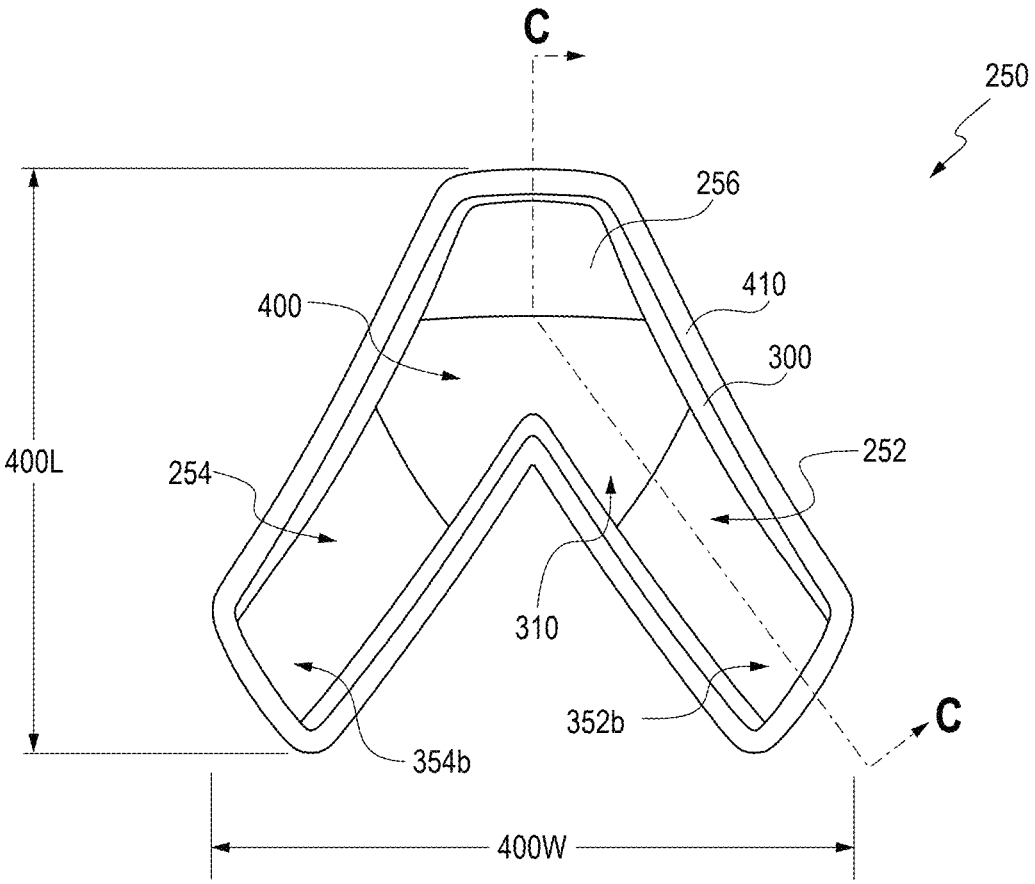
FIG. 4 is a bottom plan view of a component of the sole pattern of FIG. 2.
Figure 5:
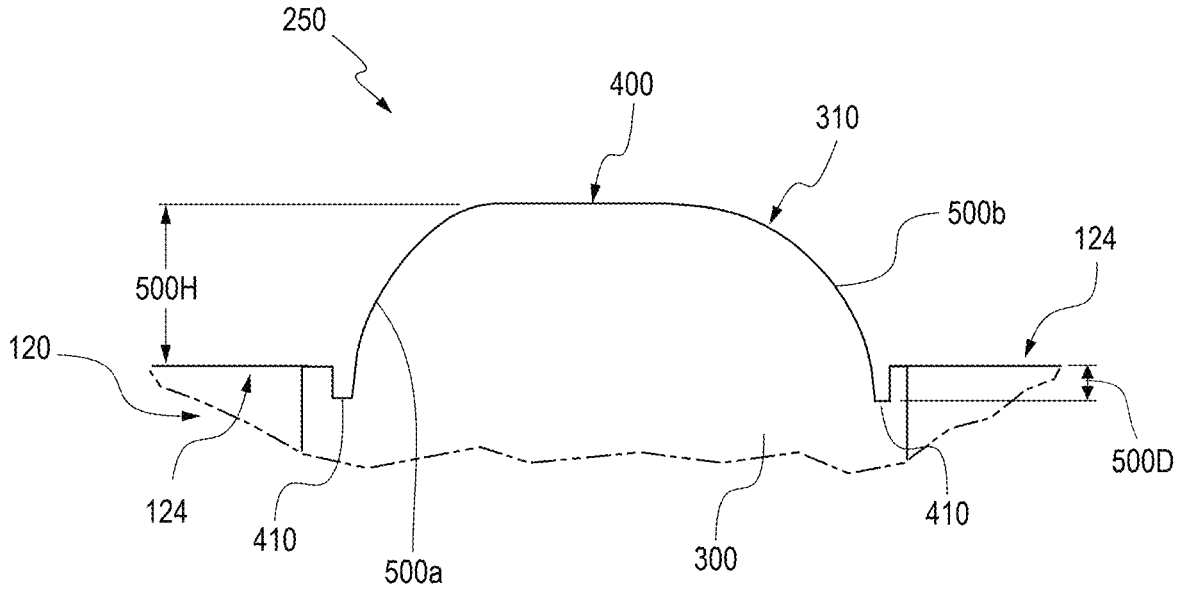
FIG. 5 is a cross-sectional view of the component of FIG. 4 taken along the line C-C.
Figure 6:
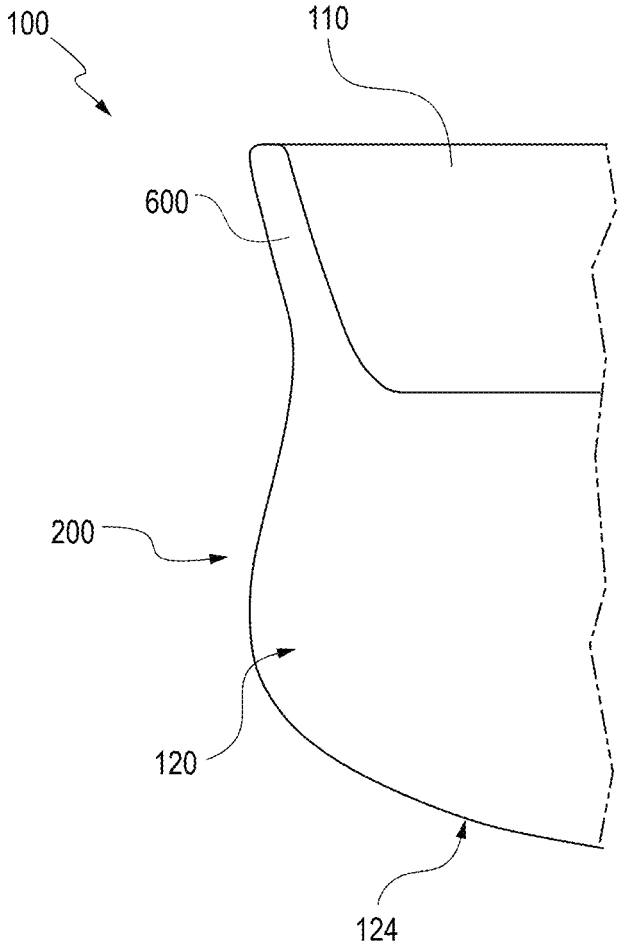
FIG. 6 is a cross-sectional view of a portion of the sole of FIG. 2 taken along the line A-A.

Together, FIGS. 4-6 further illustrate a tread member 250 and the height profile of various regions of the tread member 250. FIG. 4 illustrates a bottom plan view of the tread member 250. The tread member 250 may be defined by an overall length 400L and an overall width 400W.

The overall length 400L may be at least about 15 mm. For example, the overall length 400L may be at least about 15 mm, or at least about 17 mm, or at least about 20 mm, or at least about 21 mm, or at least about 22 mm, or at least about 23 mm, or at least about 24 mm, or at least about 25 mm, or at least about 26 mm, or at least about 27 mm, or at least about 28 mm, or at least about 29 mm, or at least about 30 mm.

Alternatively, the overall length 400L may be at least 15 mm. For example, the overall length 400L may be at least 15 mm, or at least 17 mm, or at least 20 mm, or at least 21 mm, or at least 22 mm, or at least 23 mm, or at least 24 mm, or at least 25 mm, or at least 26 mm, or at least 27 mm, or at least 28 mm, or at least 29 mm, or at least 30 mm.

The overall width 400W may be at least about 10 mm. For example, the overall width 400W may be at least about 10 mm, or at least about 13 mm, or at least about 15 mm, or at least about 16 mm, or at least about 17 mm, or at least about 18 mm, or at least about 19 mm, or at least about 20 mm, or at least about 21 mm, or at least about 22 mm, or at least about 23 mm, or at least about 24 mm, or at least about 25 mm.

Alternatively, the overall width 400W may be at least 10 mm. For example, the overall width 400W may be at least 10 mm, or at least 13 mm, or at least 15 mm, or at least 16 mm, or at least 17 mm, or at least 18 mm, or at least 19 mm, or at least 20 mm, or at least 21 mm, or at least 22 mm, or at least 23 mm, or at least 24 mm, or at least 25 mm.

In some instances, each tread member 250 of the tread pattern 130 may have substantially the same overall length 400L and/or overall width 400W. In other instances, however, one or more tread members 250 may have an overall length 400L and/or an overall width 400W that is smaller or larger than the overall length 400L and/or the overall width 400W of one or more other tread members 250.

A central area 400 of the tread member 250 may include at least a first portion of the first arm 252 and at least a second portion of the second arm 254, but the central area 400 may not extend to the vertex 256 or to either of the distal ends 352*b*, 354*b*. Alternatively, the central area 400 may include at least the first portion of the first arm 252, the second portion of the second arm 254, and a third portion of the vertex 256. In yet another alternative, the center region may be positioned between the arms 252, 254 and the vertex 256.

A channel 410 may line the periphery of each tread member 250. The channel 410 may comprise a recess in the outsole 120 that surrounds the tread member 250. In some instances, the channel 410 may increase the ability of the tread member 250 to flex while the shoe 100 is in use, thereby improving the comfort and/or grip of the shoe 100 as perceived by the wearer 105.

In the example of FIG. 4, the underside 310 of the tread member 250 may have a smaller area than the base of the tread member 250 that comes into contact with the bottom surface 124 of the outsole 120. Thus, in the bottom plan view of FIG. 4, one or more of the sidewalls 300 of the tread member 250 may be visible. In other instances, however, the underside 310 of the tread member 250 may have an area that is equal to or greater than the area of the base of the tread member 250.

FIG. 5 shows a cross-sectional view of the tread member 250 of FIG. 4 taken along the line C-C. The cross-sectional view of FIG. 5 corresponds to a profile view of a sidewall 300. Thus, the height 500H of FIG. 5 corresponds to the height 300H of the sidewall 300 as illustrated in FIG. 3. At the central area 400, the underside 310 of the tread member 250 may be substantially flat. Thus, at the central area 400, the height 500H may be substantially constant. Additionally, the tread member 250 may include a first curved area 500*a* and a second curved area 500*b* on either side of the central area 400. The first and second curved areas 500*a*, 500*b* may be referred to collectively as the curved areas 500.

At the curved areas 500, the height 500H may be variable. For example, the height 500H at the curved areas 500 may taper between the central area 400 and the bottom surface 124 of the outsole 120. In some instances, the rate of tapering of the height 500H at the first curved area 500*a* may be substantially equivalent to the rate of tapering of the height 500H at the second curved area 500*b*. In other instances, the rate of tapering of the height 500H at the first curved area 500*a* may be less than or greater than the rate of tapering of the height 500H at the second curved area 500*b*.

Additionally, the channel 410 may surround the periphery of the tread member 250 such that it is disposed between each of the curved areas 500 and the bottom surface 124 of the outsole 120. As illustrated in FIG. 5, the channel 410 may have a depth 500D measured with respect to the bottom surface 124. The depth 500D of the channel 410 may be about 1 mm. For example, the depth 500D of the channel 410 may be no more than about 1 mm, or no more than about 2 mm, or no more than about 3 mm.

Alternatively, the depth 500D of the channel 410 may be 1 mm. For example, the depth 500D of the channel 410 may be no more than 1 mm, or no more than 2 mm, or no more than 3 mm.

FIG. 6 shows a cross-sectional view of a portion of the first end 200 of the outsole 120 of FIG. 2 taken along the line A-A. The cross-sectional view of FIG. 6 provides a view of a portion of the outsole 120 and the upper 110 of the shoe 100 at the first end 200. As shown, the outsole 120 may comprise a lip 600 positioned proximate or adjacent to a periphery or an outer edge of the outsole 120 and extending upwardly therefrom. For example, the outsole 120 may be a cup sole. Thus, the lip 600 lining the periphery of the outsole 120 may cup, hug, enclose, encompass, or otherwise surround and/or support the upper 110.

As is evident from the foregoing description, certain aspects of the present invention are not limited by the particular details of the examples illustrated herein, and it is therefore contemplated that other modifications, applications, variations, or equivalents thereof, will occur to those skilled in the art. Many such changes, modifications, variations and other uses and applications of the present constructions will, however, become apparent to those skilled in the art after considering the specification and the accompanying drawings. In addition, unless mention was made above to the contrary, it should be noted that all of the accompanying drawings are not to scale. All such changes, modifications, variations and other uses in applications which do not depart from the spirit and scope of the present inventions are deemed to be covered by the inventions which are limited only by the claims which follow.

The invention claimed is:

1. An outsole comprising:
a surface; and
a tread pattern arranged on the surface, the tread pattern including a plurality of tread members, each tread member of the plurality of tread members having a first arm and a second arm, wherein each of the first arm and the second arm tapers in height from a first height to a second height shorter than the first height;
wherein each of the tread members is surrounded by a recess in the surface that increases a flexibility of the respective tread member;
wherein the plurality of tread members is arranged in nested rows of the tread members.

2. The outsole of claim 1, wherein the first arm and the second arm converge with each other at a junction.

3. The outsole of claim 2, wherein the junction is a vertex between the first arm and the second arm.

4. The outsole of claim 3, wherein each tread member of the plurality of tread members is V-shaped.

5. The outsole of claim 3, wherein each tread member of the plurality of tread members is semi-circular in shape.

6. The outsole of claim 2, wherein each of the first arm and the second arm tapers in height from the first height at a proximal end proximate the junction to the second height at a distal end.

7. The outsole of claim 1, wherein the surface has a first region, a second region, and a third region, the tread pattern being arranged on the first region and the third region.

8. The outsole of claim 7, wherein the second region is devoid of the tread pattern.

9. The outsole of claim 8, wherein the second region is between the first region and the third region.

10. The outsole of claim 1, wherein each of the first arm and the second arm includes curved sidewalls extending between the surface and a flat opposite the surface.

11. A shoe comprising:
an upper; and
an outsole coupled to the upper, the outsole including:
a surface; and
a tread pattern arranged on the surface, the tread pattern including a plurality of tread members, each tread member of the plurality of tread members having a first arm and a second arm, wherein each of the first arm and the second arm tapers in height from a first height to a second height shorter than the first height;
wherein each of the tread members is surrounded by a recess in the surface that increases a flexibility of the respective tread member;
wherein the plurality of tread members is arranged in nested rows of the tread members.

12. The shoe of claim 11, wherein the first arm and the second arm converge with each other at a junction.

13. The shoe of claim 12, wherein each tread member of the plurality of tread members is V-shaped or semi-circular in shape.

14. The shoe of claim 12, wherein each of the first arm and the second arm tapers in height from the first height at a proximal end proximate the junction to the second height at a distal end.

15. The shoe of claim 11, wherein the surface has a first region, a second region, and a third region, the second region located between the first region and the third region, the tread pattern being arranged on the first region and the third region, the second region being devoid of the tread pattern.

16. The shoe of claim 11, wherein each of the first arm and the second arm includes curved sidewalls extending between the surface and a flat opposite the surface.

17. An outsole comprising:
a surface; and
a tread pattern arranged on the surface, the tread pattern including a plurality of tread members, each tread member of the plurality of tread members having a first arm and a second arm, wherein each of the first arm and the second arm tapers in height from a first height to a second height shorter than the first height;
wherein each of the tread members is surrounded by a recess in the surface that increases a flexibility of the respective tread member;
wherein the first arm and the second arm converge with each other at a junction;
wherein each of the first arm and the second arm tapers in height from the first height at a proximal end proximate the junction to the second height at a distal end;
wherein each of the first arm and the second arm define a convex ramp between the proximal end and the distal end.

18. A shoe comprising:
an upper; and
an outsole coupled to the upper, the outsole including:
a surface; and
a tread pattern arranged on the surface, the tread pattern including a plurality of tread members, each tread member of the plurality of tread members having a first arm and a second arm, wherein each of the first arm and the second arm tapers in height from a first height to a second height shorter than the first height;
wherein each of the tread members is surrounded by a recess in the surface that increases a flexibility of the respective tread member;
wherein the first arm and the second arm converge with each other at a junction;
wherein each of the first arm and the second arm tapers in height from the first height at a proximal end proximate the junction to the second height at a distal end;
wherein each of the first arm and the second arm define a convex ramp between the proximal end and the distal end.

* * * * *